United States Patent [19]

Sentinella

[11] 4,114,726

[45] Sep. 19, 1978

[54] FIRE ESCAPE DEVICES

[76] Inventor: Victor Edward Sentinella, 68, Dome Hill, Caterham, England, CR36EB

[21] Appl. No.: 735,779

[22] Filed: Oct. 26, 1976

[30] Foreign Application Priority Data

Oct. 29, 1975 [GB] United Kingdom ..... 44545/75

[51] Int. Cl.[2] ..... A62B 1/16

[52] U.S. Cl. ..... 182/5; 188/65.5

[58] Field of Search ..... 182/5, 6, 7; 188/65.4, 188/65.5

[56] References Cited

U.S. PATENT DOCUMENTS

| | | | |
|---|---|---|---|
| 252,829 | 1/1882 | Williams | 188/65.5 |
| 300,248 | 6/1884 | Greene | 188/65.5 |
| 485,954 | 11/1892 | Lester | 188/65.5 |
| 682,869 | 9/1901 | Hammerly | 188/65.5 |
| 814,458 | 3/1906 | Kramer | 188/65.5 |
| 930,580 | 8/1909 | Weinstock | 188/65.5 |

*Primary Examiner*—Reinaldo P. Machado
*Attorney, Agent, or Firm*—Brisebois & Kruger

[57] ABSTRACT

A fire escape device comprises a pair of arms pivotally connected together at respective ends for movement between an open position and a closed position. The distal ends of the arms can be fastened together when the arms are in the closed position. The arms are provided with respective means each defining at least a part of a passage and when the arms are in the closed position the respective means cooperate to thereby define a tortuous passageway between the arms for a rope or cable. The fire escape device can be used in a fire escape apparatus including also a length of cable and a harness. In operation a person attaches one end of the cable to a support, attaches the device to the cable and attaches a harness supporting him to the device; he then descends along the cable to the ground with the fire escape device braking his rate of descent.

4 Claims, 14 Drawing Figures

FIRE ESCAPE DEVICES

This invention relates to fire escape devices and fire escape apparatus incorporating same.

In the past various devices have been proposed to enable people to lower themselves and others down the outside of high buildings when trapped in a fire on the upper floors of the building. However, these devices have tended to require a permanent installation and to be of complex construction. For example, rooms on the upper floors of some buildings are provided with a fire escape apparatus comprising a drum fixed to a secure mounting (which is some rooms may have to be specially provided) and a length of rope or cable wound around the drum and provided with a harness at each end; and automatic brake is provided in the drum to limit the speed of rotation of the drum to a safe speed. In use a person throws one end of the cable out of the room and then secures himself in the harness attached to the other end of the cable. He is then able to descend to the ground at a safe speed limited by the automatic brake. As the person descends the other end of the cable is raised up back to the drum ready for use by a second person. In this way a number of persons can lower themselves safely to the ground in the event of a fire. However the device has various disadvantages some of which have already been mentioned; further disadvantages are that the mounting of the drum beside a window is unsightly and also the apparatus is elaborate and therefore expensive.

It is an object of the invention to provide a fire escape device of simple construction and of low cost.

According to the invention there is provided a fire escape device comprising a pair of arms mounted for movement between an open position and a closed position, a first means on one arm defining at least a part of a passage, a second means on the other arm defining at least a part of a passage, and fastener means for fastening the arms together in the closed position, the first means cooperating with the second means, when the arms are in the closed position, to define a tortuous passage for an elongate body, for example a cable, the tortuosity of the passage being such that movement of an elongate body, for example a cable, along the passage is retarded.

The device can further include handle means on each of said arms for enabling the device to be held in the closed position.

The first means can comprise at least one pulley wheel rotatably mounted on said one arm and the second means can comprise at least one pulley wheel rotatably mounted on the other arm.

The arms can be pivotally connected together at respective ends.

The fastener means can comprise distal end portions of the arms, each end portion being formed with a hole for receiving a fastener.

One end portion can be formed with a slot for allowing limited pivotal movement of the arms in the closed position.

A plurality of fastener means can be provided for fastening the arms together in any one of a plurality of closed positions.

The device can further include a ratchet and pawl mechanism mounted on the distal ends of the arms for securing the arms in any one of several closed positions.

Each hole can be a slot extending diagonally to the axis of a respective arm, the arrangement being such that, when a fastener is passed through the slots on each arm, movement of the fastener along the axis of the device away from the pivotal connection of the arm, is operative to further close the arms.

The first means can comprise a plurality of upstanding projections on said one arm and the second means can comprise a plurality of upstanding projections on said other arm.

Said one arm can be of ladder like construction being provided with a plurality of rungs comprising said first means and said other arm can be provided with a plurality of rungs comprising said second means and projecting from a body part of said other arm.

A plurality of pulley wheels can be rotatably mounted on each arm.

Means for adjusting the frictional resistance of at least one of the pulley wheels to rotation can be provided.

When the arms are in the closed position, the channel sections of the arms can overlap to define an elongate chamber housing the pulley wheels.

According to another aspect of the invention a fire escape apparatus comprises an elongate body, for example a cable, provided with attachment means at one end for attaching the cable to an anchorage, a fire escape device for retarded movement along the elongate body, the device comprising a pair of arms mounted for movement between an open position for locating the device around the cable and a closed position for retarded movement of the device along the cable, a first means or one arm, defining at least a part of a passage and a second means on the other arm defining at least a part of a passage, and a harness for supporting a person, the harness being provided with a fastener fastenable to the fire escape device when the arms are in the closed position, the first means cooperating with the second means, when the arms are in the closed position, to define a tortuous passage for the elongate body, the tortuosity of the passage being such that, in use, movement of the elongate body along the passage is retarded.

By way of example only, certain illustrative embodiments of the invention will now be described with reference to the accompanying drawings, in which.

Figure 1:
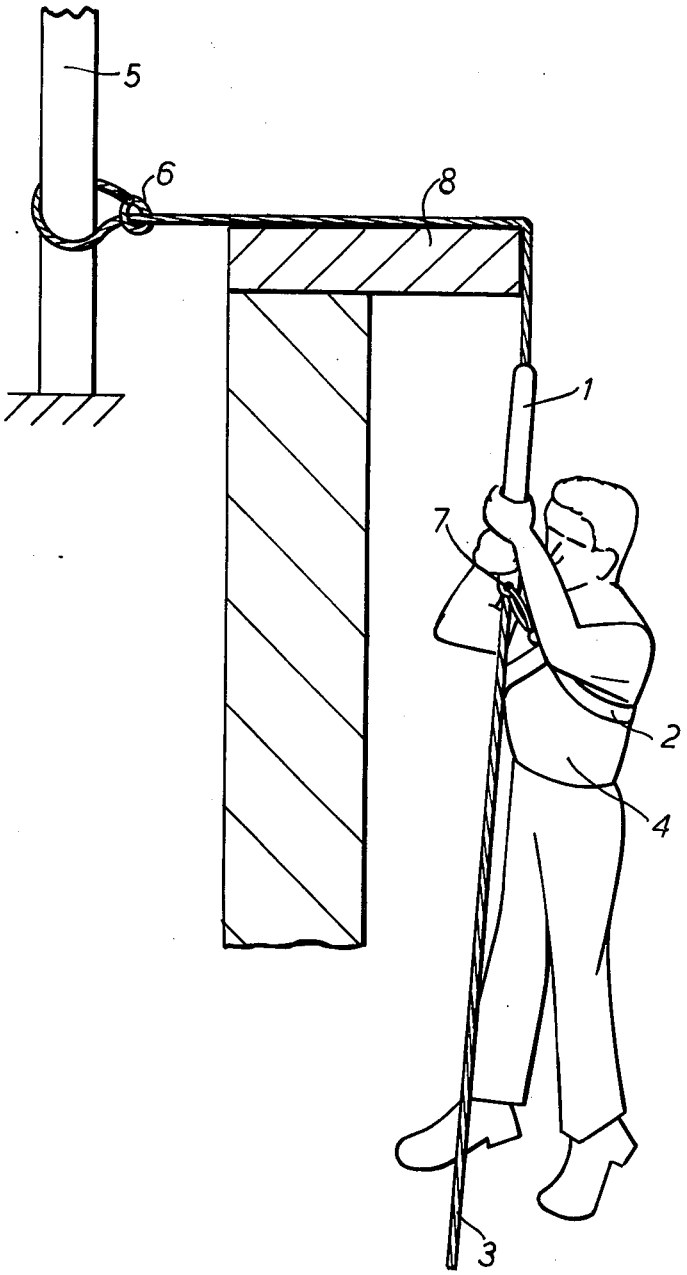
FIG. 1 is a schematic illustration of a fire escape apparatus embodying the invention in use.

Referring to FIG. 1, the fire escape apparatus shown comprises a fire escape device 1, a harness 2 secured to the lower end of the device 1 and a steel cable 3 which passes through the device 1. The braking effect necessary to slow down the descent of a person 4 using the apparatus is achieved in the device 1. The construction and operation of a first form of the device 1 will now be described.

Figure 2:
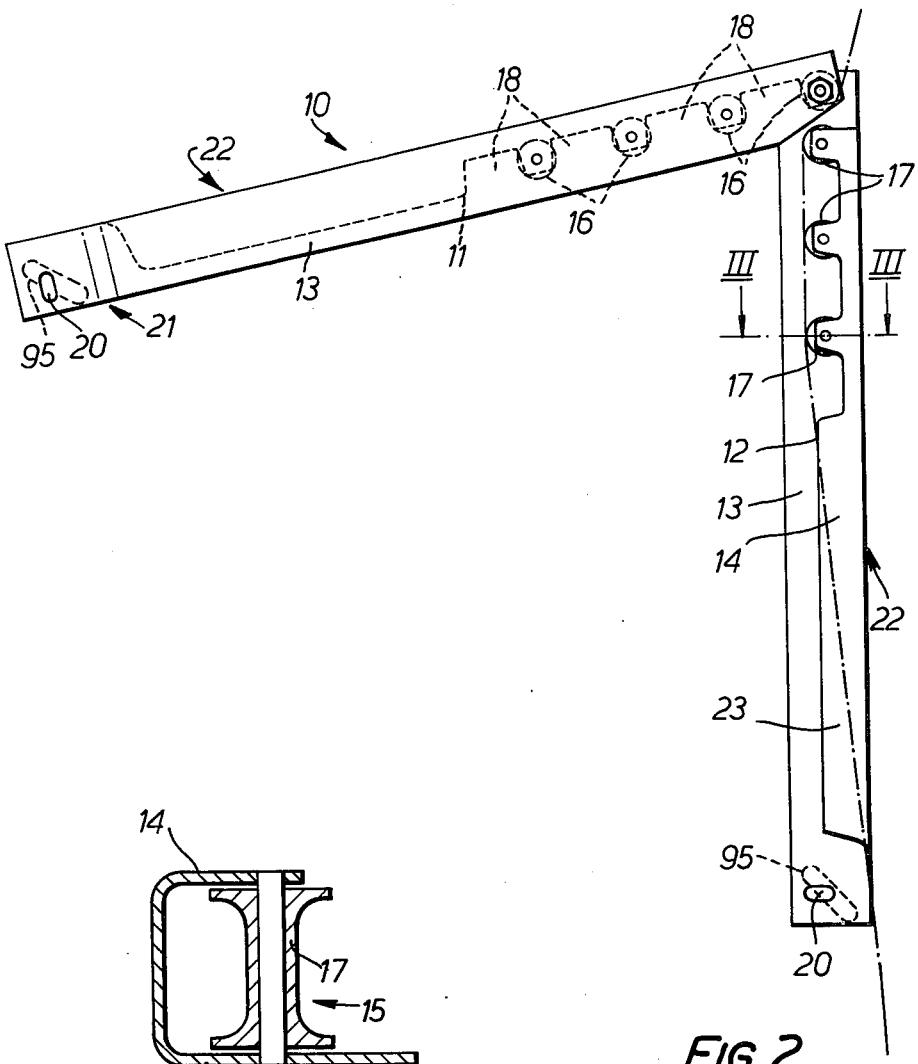
FIG. 2 is a plan view of a fire escape device embodying the invention.
Figure 3:
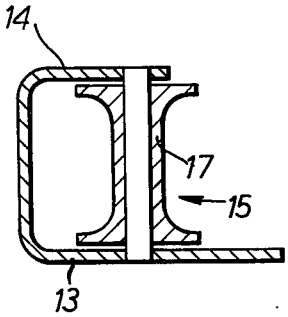
FIG. 3 is a section view along the lines III — III of FIG. 2.

Referring to FIGS. 2 and 3 a fire escape device 10 comprises two arms 11 and 12 made of steel and of channel shaped section (see FIG. 3) pivotally connected together at one end. Each arm, 11, 12 has a flat base wall 13, which is bent over to form a parallel spaced wall 14, of less depth than the wall 13 and to define a channel 15 along each arm. The channel 15 of the arm 11 houses four pulley wheels 16 rotatably mounted in the channel, one pulley wheel being mounted on the pivotal connection between the arms 11 and 12. The channel 15 of the arm 12 houses three pulley wheels 17 rotatably mounted in the channel.

The wall 14 of each arm 11, 12 is provided with recessed portions 18, 19 to accomodate the pulley wheels 17, 16 respectively. The pulley wheels 17 are staggered in relation to the pulley wheels 16 so that on closing the arms 11 and 12 each of the pulley wheels 17 is interposed between respective pairs of pulley wheels 16.

As seen in FIG. 2 the deeper wall 13 of the arm 11 is uppermost whereas the shallower wall 14 of the arm 12 is uppermost. Thus on closing together the arms 11 and 12 the wall 13 of the arm 11 overlaps the wall 14 of the arm 12 and similarly the wall 13 of the arm 12 overlaps the wall 14 of the arm 11 so that in the closed position the arms 11 and 12 together define an elongate chamber housing a plurality of pulley wheels. Parts 22 of each arm form a convenient handle for holding the device in the closed position.

The arms 11, 12 are each provided with a fastening hole 20 and the arm 11 is stepped in the region designated 21 downwards (as seen in FIG. 2) so that when the arms 11 and 12 are closed the holes 20 lie closely adjacent each other.

The operation of the device 10 will now be described with reference to FIGS. 1 to 3, the device 10 being designated by reference numeral 1 in FIG. 1.

The device 10, constitutes one part of a fire escape apparatus also including a harness 2 and steel cable 3. In the event of fire the person 4 first obtains the apparatus which may be conveniently stored in a cupboard and fastens the steel cable 3 to any secure anchorage 5 in the room, such as a door handle or window frame post. Fastening is facilitated by the provision of a snap hook 6 on the end of the cable 3; the end of the cable can be simply passed round the anchorage 5 and the hook 6 slipped back onto the cable 3.

The device 10 is next attached to the cable; the device 10 is positioned under the cable in the position illustrated in FIG. 2, the cable being designated by the chain dotted line 23. The arms 11 and 12 are then closed so that the cable 3 is forced into the tortuous passage defined by the pulleys 16 and 17. The harness 2 is then attached to the device 1 by means of a snap hook or clip 7 fastened to the harness, the snap hook being passed through the holes 20 on the arms 11 and 12 thus securing the arms 11 and 12 in the closed position. Ideally the person attaches the device to the cable at a location just further along the cable than the distance from the anchorage point to the exterior of the building; thus in FIG. 1, the device should be attached in the position shown just clear of a window sill 8. However the exact point of attachment is not critical to the safe operation of the device.

The person 4 secures himself in the harness 2 (if he has not already done so) and throws the free end of the cable out of the building over the window sill 8. He is then able to climb out over the window sill 8 and when he releases his grip on the building he will slide down the cable 3 together with the device 10 under the control of the device. The portions 22 and 23 of the arms 11 and 12 form a convenient hand grip for the person 4. The manner in which the device 10 controls the descent will now be described.

As has already been explained the pulleys 16 and 17 form a tortuous passageway. The radius of curvature of this path around the pulleys is approximately the same as the diameter of the cable so that the cable suffers severe strains when forced into this passageway. The magnitude of the strains is such that considerable internal friction is generated in the cable.

As the device 10 passes down the cable so the cable is being strained and unstrained; this straining and unstraining of the cable absorbs a considerable amount of energy due to the internal friction in the cable and thus acts as a very effective braking force. Furthermore, the faster the device 10 descends the greater is the length of cable strained in a given time and therefore the amount of energy absorbed in a given time is correspondingly greater and the braking force is correspondingly greater.

It will be clear that by suitable positioning of the pulleys 16 and 17 on the arms 11 and 12 and by suitable selection of cable a fire escape device can be produced which will control the rate of descent of a person at a safe speed.

In one particular example of the embodiment just described the pulley wheels 16, 17 are three quarters of an inch in diameter, the spacing between the centres of adjacent pulley wheels on each arm being one and three quarter inches. The cable is a steel cable of three sixteenths of an inch diameter made up of seven main strands each main strand comprising seven individual strands. In the closed position of the arms the centres of the pulley wheels 16 and 17 are disposed in approximately a straight line.

The device 10 just described can be made of structural nylon rather than steel. In this case the pulleys 16, 17 can be press fitted into the channels 15.

FIGs. 4 to 7 show a second escape device 30 similar to that already described.

The device 30 comprises two arms 31 and 32 which arms are pivotally connected at one end. Two pulley wheels 33 are mounted on the arm 32 and a pulley wheel 34 arranged to be interposed between the wheels 33 when the arms are closed is mounted on the arm 31. The pulley wheels 33 are mounted on spindles on the arm 32 and the pulley wheel 34 is mounted on a projection 35 of the frame. Each pulley wheel 33, 34 is recessed around its rim in the conventional manner so as to introduce a cable into the rim of each pulley wheel when the arms 31, 32 are closed.

Figure 5:
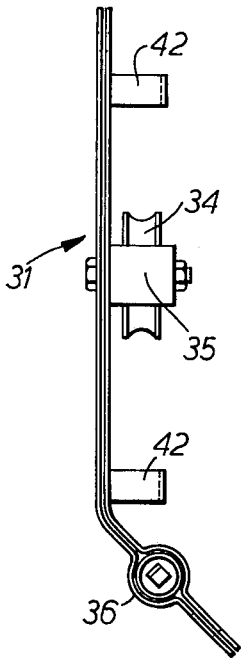
FIG. 5 is a side view of part of the second device.
Figure 6:
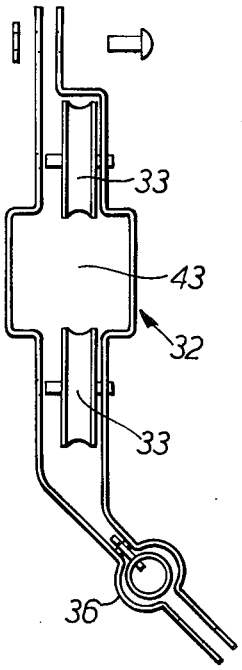
FIG. 6 is a side view of another part of the second device.

FIG. 5 shows an end view of arm 31; the arm 31, as can be seen, comprises two parallel strips of material. Similarly FIG. 6 shows an end view, partially exploded, of the arm 32; the arm 32 comprises two parallel strips of material which are shaped to enclose the pulleys and drilled to accommodate the spindles of pulley wheels 33. The projection 35 in the arm 31 is of similar duplex construction and is drilled to accommodate the spindles of pulley wheels 33. The projection 35 in the arm 31 is of similar duplex construction and is drilled to accommodate the spindle of pulley wheel 34. The separation of the strips of the arm 32 is enlarged in the region 43 where the pulley wheel 34 is interposed between the pulley wheels 33.

The pulley wheels 33 are mounted on their spindles so as to revolve freely. The pulley wheel 34 is mounted on a spindle formed from a threaded bolt with a nut so as to be clamped between the plates which form the duplex construction of the projection 35. The clamping action of the plates upon the pulley wheel can therefore be adjusted by tightening or loosening the bolt and nut upon the pulley wheel 34, and its frictional resistance to rotation increased or lessened.

The frame arm 31 carries duplex right angled projections 42 at each end on the edges of the arm 31 adjacent the arm 32. The projections 42 form guides to assist the accurate location of a cable in the device.

At the ends of the frame arms 31, 32 opposite to their connecting pivot are fitted hollow tubular handles 36, extending at right angles to the arms and coaxial when the arms 31, 32 are in the closed position. A ratchet and pawl mechanism mounted within the handles 36 provides an automatic means of locking the arms 31, 32 together in the closed position. The pawl 37 can be released from the ratchet 38 by operation of a lever 39, whereupon the handles can be moved apart or together as desired.

Each arm 31, 32 is provided with hole 40 at the end opposite to the connecting pivot, to form an attachment position for a harness.

The operation of the device 30 is very similar to that of the device 10. The device is used with the other fire escape apparatus shown in FIG. 1 in the same manner as the device 10; however the method of controlling the rate of descend is somewhat different and this will now be described.

Figure 4:
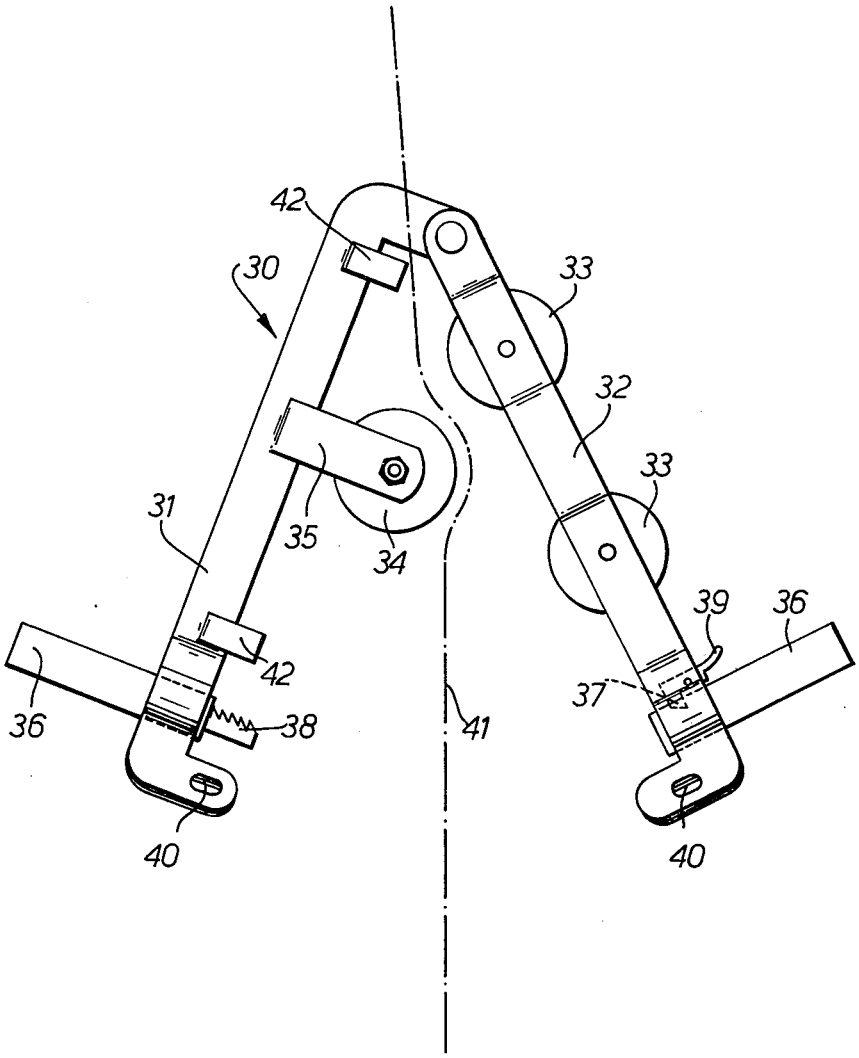
FIG. 4 is a plan view of a second fire escape device embodying the invention.
Figure 7:
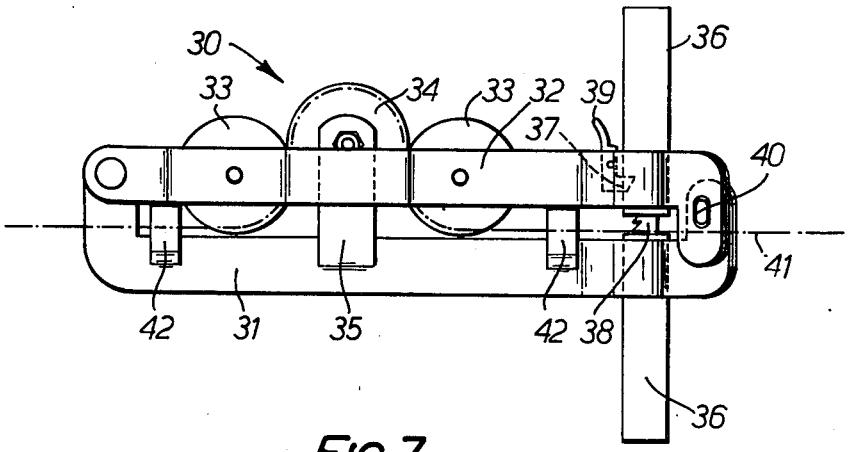
FIG. 7 is a plan view of the second device in an operational position.

The dotted line 41 in FIGS. 4 and 7 indicates the path of the cable through the device 30. The cable is positioned in the device 30 while it is in the position shown in FIG. 4 and the device is then closed until the holes 40 are aligned whereupon the harness 2 can be attached to the device. The cable is thus again made to follow a tortuous path so that a considerable braking effect is again achieved by the internal friction of the cable. A secondary braking effect however is also produced by the frictional resistance of the pulley wheel 34 which can be adjusted as already described.

The holes 40 of the device 30 are bigger than the holes 20 of the device 10 and therefore when the harness 2 is attached to the device 30 limited relative pivotal movement of arms 31 and 32 is still possible. This pivotal movement is controlled by the ratchet and pawl mechanism as already described. The effect of moving the arms 31 and 32 closer together is to increase the strains in the cable and thus increase the braking effect in the cable; similarly separating the arms 31 and 32 reduces the strains in the cable thus reducing the braking effect in the cable. Thus the speed of ascent or descent of the device 30 can be varied by altering the ratchet and pawl setting; this variation can be carried out by a person during descent or alternatively can be preset before descending according to the weight of the person descending.

Figure 8:
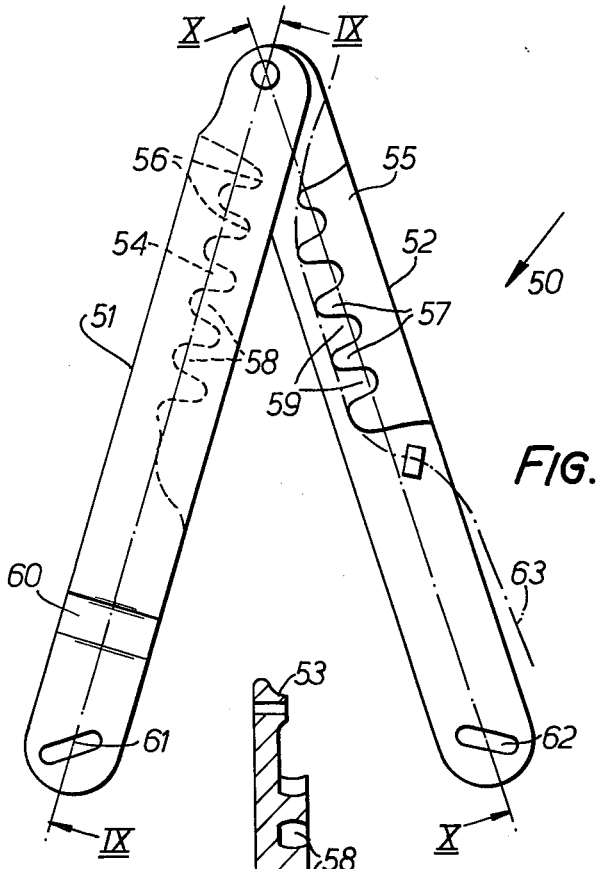
FIG. 8 is a plan view of a third fire escape device embodying the invention.
Figure 9:
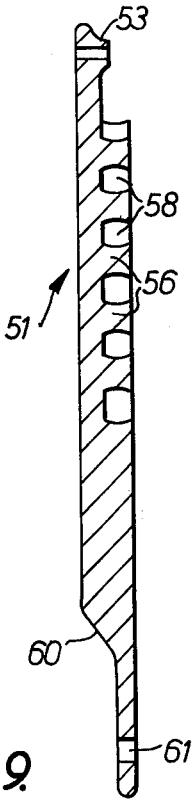
FIG. 9 is a section view along the lines 1X — 1X of FIG. 8.
Figure 10:
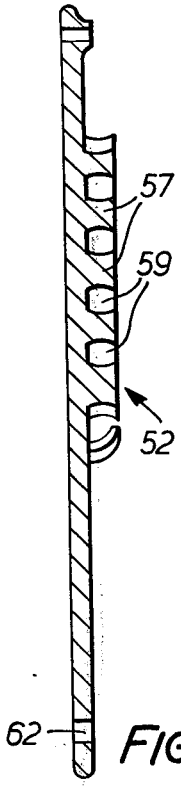
FIG. 10 is a section view along the lines X — X of FIG. 8.

FIGS. 8 to 10 show a fire escape device 50 for use with very light flexible rope such as braided nylon rope. Such rope has very little resistance to being tightly curved so that in order to produce the necessary braking effect the rope must be forced into a series of very tight curves. The device 50 comprises two unitary arms 51, 52 which are solid mouldings in structural nylon; a metal moulding or casting could alternatively be used. The arms 51, 52 are pivotally connected at one end by a pivot passing through a boss 53 on each arm. The bosses 53 are shaped such that when the arms are pivotally connected they form a concave guide for a rope.

Each arm 51, 52 is provided, on the face lying adjacent the other arm, with respective shaped upstanding parts 54 and 55 which are shaped to define projecting portions 56 and 57 respectively and recessed portions 58 and 59 respectively. When the arms 51 and 52 are closed the projecting portions 56 of the arm 51 intermesh with the recessed portions 59 of the arm 52 and similarly the projecting portions 57 intermesh with the recessed portions 58. Thus with the arms 51 and 52 closed a very narrow passageway only very slightly bigger than the rope is defined between the upstanding parts 54 and 55. The peripheral edges of the upstanding parts are of concave shape so as to act as a guide for the rope.

The arm 51 is stepped inwardly toward the adjacent arm 52 in the region 60 so that when the arms 51, 52 are closed the ends of the arms distant from their pivotal connection lie face to face and closely adjacent. These adjacent faces are each provided with respective slots 61, 62 extending diagonally across the faces.

In operation of the device 50 the rope is laid along the dotted line reference 63 and passed under a guide 54 on the arm 52. The device 50 is then closed and the clip 7 of the harness passed through the slots 61, 62. Since the arms 51, 52 are furthrest apart when the clip 7 of the harness 2 is located in the top of the slots, this is the position which the clip will adopt. However when a person descends down the rope using the device 50 his weight will urge the clip 7 down the slot, closing the arms 51, 52 with a camming action. The heavier the person the further down the slots 61, 62 will the clip 7 be forced thus further closing the arms 51, 52 and increasing the braking action. In this way a greater braking force is automatically achieved for a heavier person.

The trailing edges of the arms 51, 52 are rounded to provide a hand grip for a person descending.

The projecting portions 56, 59 and the recessed portions 57, 58 are preferably parallel sided with a radius of curvature the same as that of the rope. In the device 50 just described some braking force will be provided by the frictional resistance of the projection portions 56, 59 and recess portions 57, 58 to the cable 3; this force is additional to the braking force provided by the straining and unstraining of the nylon rope as it passes through the device 50.

Additional frictional resistance can be provided by arranging the projecting and recessed portions 56, 57, 58, 59 adjacent the pivotal connection of the arms 51, 52 to define a passage for the rope slightly narrower than the rope when the arms are fully closed so that the rope is clamped in this region.

FIGS. 11 to 14 show a fourth fire escape device 70 also for use with very light flexible rope such as braided nylon rope. The device 70 comprises an arm 71, made of nylon and shown viewed from its exterior side in FIG. 12, and an arm 72, which is shown viewed from its exterior side in FIG. 13, the arms 71, 72 being pivotally connected together at one end. The arm 72 is of ladder like construction being provided with six bowed nylon rungs 73. The rungs 73 are bowed in a direction away from the arm 71. The distal end of the arm 72 is provided with a slot 74. The arm 71 comprises a pair of parallel members 75, 76 which pivotally mount a pulley 77 of concave section. Projecting from the members 75, 76 in a direction towards the arm 72 are six pairs of integral supports 78, each pair of supports carrying a respective nylon rung 79 bowed in a direction away from the arm 72. The rungs 73, 79 are arranged such that when the arms 71, 72 are closed the rungs 79 pass between the rungs 73.

The distal end of the arm 71 is provided with a slot 80.

Figure 11:
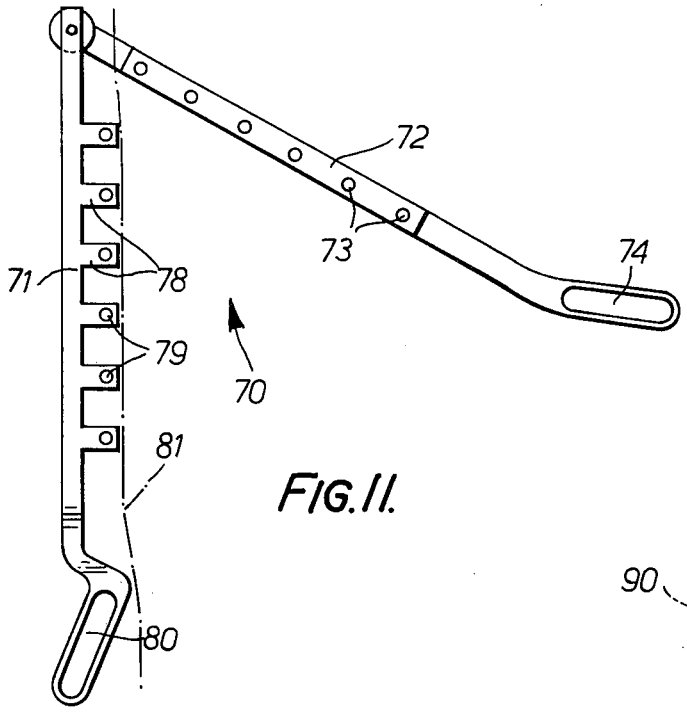
FIG. 11 is a plan view of a fourth fire escape device embodying the invention.
Figure 12:
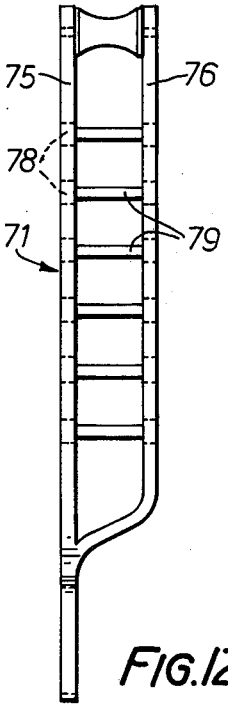
FIG. 12 is a side view of a part of the fourth device.
Figure 13:
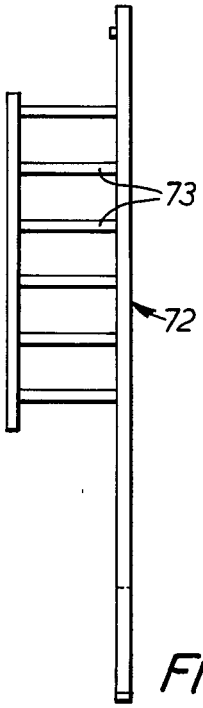
FIG. 13 is a side view of another part of the fourth device.

In operation a rope is positioned along the dotted line 81 shown in FIG. 11 and the arms 71 and 72 are closed until the slots 74 and 80 are aligned. The clip 7 of the harness is then passed through the slots which operate in the same manner as that described for the device 50. The bowed shape of the rungs ensure that the rope is properly entrained. The rungs 73, 79 are of approximately the same diameter as the rope and they are spaced apart such that as the arms 71, 72 are closed there is only just sufficient clearance between each rung 73 and an adjacent rung 79 for the rope to pass therethrough.

A fire escape device very similar to the device 70 can be used in conjunction with a steel cable. In this case the rungs 73, 79 would be replaced by pulley wheels rotatably mounted; the pulley wheels would conveniently be of concave section in order to entrain the cable.

It should be understood that the devices 30, 50 and 70 are of similar construction to the device 10 and that the operation of the devices in conjunction with the other fire escape apparatus shown in FIG. 1 is also similar. In order to avoid undue repetition the construction and operation of the devices 30, 50 and 70 where clearly the same as that of the device 10 has not been described.

While four specific embodiments of the invention have been described it should be understood that many modifications and variations may be made to the embodiments and, in particular, certain features described with reference to one embodiment may be incorporated in another embodiment. The provision of a pulley wheel whose rotation is frictionally resisted, which feature is described with reference to the device 30, could be included on the device 10. The ratchet and pawl mechanism 37, 38, 39 of the device 30 may be incorporated on the device 10, the device 50 or the device 70. Alternatively the slot fastening arrangement provided on the devices 59 and 70 could be provided on the devices 10 or 30 in place of the fastening arrangement shown. Such a slot fastening arrangement is illustrated by the dotted lines 95 in FIG. 2 which show the provision of slots in place of the fastening holes 20.

Figure 14:
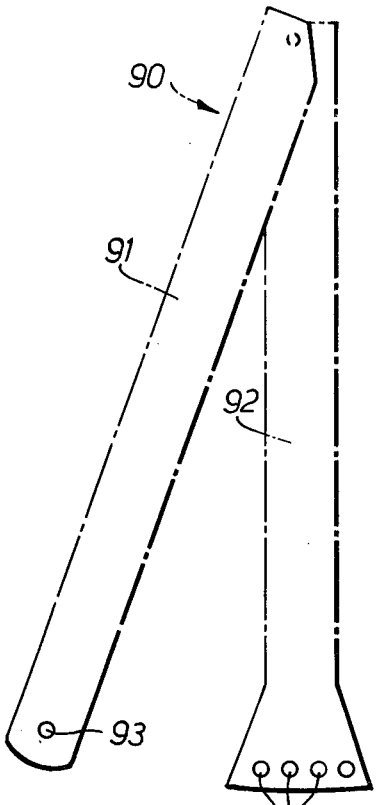
FIG. 14 is a plan view showing an alternative fastening arrangement for a fire escape device embodying the invention.

A further alternative fastening arrangement is illustrated in FIG. 14. In this arrangement a fire escape device 90 comprising two arms 91, 92 pivotally connected together is schematically illustrated by chain dotted lines. The device 90 could comprise any of the devices 10, 30, 50 and 70. The distal end of the arm 91 is provided with a single hole 93 just large enough to accommodate the clip 7 of the harness 2. The distal end of the arm 92 is provided with four separate holes 94 each of which can be aligned with the hole 93 in different positions of the arms 91 and 92. Thus by selecting one of the holes 93, the degree of braking achieved by the device 90 can be varied. It may be desirable to label the holes according to the weight of person to be carried so that children and adults can be safely conveyed at about the same rate of descent; in this case the insignia '50 lbs', '100 lbs', '150 lbs' and '250 lbs' could be placed over respective holes 94 (from left to right) to indicate which hole to use according to a persons weight.

In the embodiments described above in which a rope or cable is forced to follow a tortuous path, the sharpness of the turns which the rope or cable makes remains approximately constant along the length of the tortuous path. However it may be convenient to provide the rope or cable with a narrower or more tortuous path at the end of the path adjacent the pivot so that most of the braking of the device is achieved adjacent the pivot. In the region where the cable path is narrowest and most tortuous, the closing force required to close the two arms of the escape device is greatest; however by positioning this region adjacent the pivot, an operator holding the arms of the device at their distal ends has a considerable mechanical advantage in providing the necessary closing force.

In the operation of all the embodiments described a rope or steel cable is stored in a room and the free end of the cable or rope thrown out of the room in order to descend to the ground. However in some cases, such as for example a tall block of flats, it may be preferable to provide a number of ropes or cables permanently sited around the exterior of the building and running from the top of the building to the bottom. In this case a person wishing to use the escape apparatus, fastens a fire escape device to the rope or cable, attaches the device to his harness and descends to the ground in the same manner as before.

What is claimed is:

1. A fire escape device comprising a pair of arms mounted for movement between an open position and a closed position, a first means on one arm defining at least a part of a passage, a second means on the other arm defining at least a part of a passage, and fastener means for fastening the arms together in the closed position, the first means cooperating with the second means, when the arms are in the closed position, to define a tortuous passage for an elongate body, for example a cable, the tortuosity of the passage being such that movement of an elongate body, for example a cable, along the passage is retarded, said arms being pivotally connected together at respective ends, said fastener means comprising distal end portions of said arms, one end portion being formed with a hole for receiving a fastener, and one end portion being formed with a slot for allowing limited pivotal movement of the arms in the closed portion.

2. A fire escape device comprising a pair of arms mounted for movement between an open position and a closed position, a first means on one arm defining at least a part of a passage, a second means on the other arm defining at least a part of a passage, and fastener means for fastening the arms together in the closed position, the first means cooperating with the second means, when the arms are in the closed position, to define a tortuous passage for an elongate body, for example a cable, the tortuosity of the passage being such that movement of an elongate body, for example a cable, the tortuosity of the passage being such that movement of an elongate body, for example a cable, along the passage is retarded, said arms being pivotally connected together at respective ends, said fastener means comprising distal end portions of the arms, each end portion being formed with a hole for receiving a fastener, each hole being a slot extending diagonally to the axis of a respective arm, and the arrangement being such that, when a fastener is passed through the slots on each arm, movement of the fastener along the axis of the device away from the pivotal connection of the arms is operative to further close the arms.

3. A fire escape device according to claim 1, further comprising a harness for supporting a person and fastenable to the fire escape device when the arms are in the closed position.

4. A fire escape device according to claim 3 wherein said harness is fastened to the fire escape device by said fastener means.

* * * * *